United States Patent [19]

Vickers

[11] Patent Number: 4,630,333

[45] **Date of Patent: * Dec. 23, 1986**

[54] ADJUSTABLE FRICTION HINGE

[75] Inventor: James H. Vickers, Middletown Township, Delaware County, Pa.

[73] Assignee: Southco, Inc., Concordville, Pa.

[ * ] Notice: The portion of the term of this patent subsequent to Jan. 1, 2002 has been disclaimed.

[21] Appl. No.: 809,342

[22] Filed: Dec. 16, 1985

[51] Int. Cl.[4] ..... E05D 11/08

[52] U.S. Cl. ..... 16/338; 16/342; 16/386; 16/DIG. 13

[58] Field of Search ..... 16/338, 342, 380, 385, 16/386, DIG. 13

[56] References Cited

U.S. PATENT DOCUMENTS

| | | | |
|---|---|---|---|
| 1,033,582 | 7/1912 | Harris | 16/338 |
| 1,175,560 | 3/1916 | Rixson | 16/338 |
| 1,922,365 | 8/1933 | Heasley | 16/338 |
| 2,602,957 | 7/1952 | Anderson | 16/338 |
| 2,929,093 | 3/1960 | Conlee | 16/338 |
| 3,593,364 | 7/1971 | Lia | 16/380 |
| 3,703,742 | 11/1972 | Konishi | 16/385 |
| 4,175,315 | 11/1979 | Hayes | 16/380 |

FOREIGN PATENT DOCUMENTS

| | | | |
|---|---|---|---|
| 356464 | 6/1938 | Italy | 16/386 |
| 11488 | 5/1969 | Japan | 16/386 |

*Primary Examiner*—Gene P. Crosby
*Attorney, Agent, or Firm*—Paul & Paul

[57] ABSTRACT

An adjustable friction hinge assembly of thermoplastic material comprises a first hinge leaf having spaced-apart non-adjustable knuckles having non-circular through holes and a second hinge leaf having a single clamping knuckle which fits into the space between the spaced-apart non-adjustable knuckles. The hinge pin is a unitary pin having non-circular end portions having a diameter which is larger than that of the circular cross-section intermediate portion. The inside diameter of the middle knuckle as molded is too small to receive the non-circular end portion of the hinge pin. During assembly, the inside diameter of the middle knuckle is extended to receive the non-circular end portion of the hinge pin. The frictional torque resistance on the knuckle is controlled by the middle clamping knuckle which is controlled by an adjustment screw. Some of the plastic material of the clamping knuckle is squeezed into the threads of the adjustment screw during tightening thereby to maintain the adjustment at its initially-set position.

4 Claims, 9 Drawing Figures

ADJUSTABLE FRICTION HINGE

CROSS-REFERENCE TO RELATED TO U.S. PATENT

The hinge described and claimed in the present application is an improvement over that described and claimed in my U.S. Pat. No. 4,490,884, granted Jan. 1, 1985 and assigned to Southco, Inc., Concordville, Pa., the assignee of the present application.

BACKGROUND OF THE INVENTION

This invention relates to a hinge assembly for an access door or lid or cover or the like.

The hinge assembly of the present application is particularly useful on access doors which, when opened, are intended to remain in the open position and not swing shut, or which, when raised, will remain in the raised position and not fall down.

In my prior U.S. Pat. No. 4,490,884, an adjustable friction hinge assembly is shown made preferably of thermoplastic material and comprising a first hinge leaf having a pair of spaced-apart non-adjustable knuckles having noncircular, preferably hexagonal, through holes, and a second hinge leaf having a single adjustable knuckle which fits into the space between the spaced-apart non-adjustable knuckles and forms the middle knuckle of a three-knuckle hinge. The middle knuckle has a wrap-around portion and a pair of extensions therefrom. The inside diameter of the middle knuckle is adjustable and the adjustment is controlled by an adjustment screw which controls the spacing between the middle-knuckle extensions. By these means, the frictional torque resistance of the middle knuckle on the hinge pin in controlled. Provision is made for squeezing some of the plastic material of one of the middle-knuckle extensions into the threads of the adjustment screw, thereby to maintain the adjustment at its initially set position despite repeated openings and closings of the lid.

In a preferred embodiment, the opposite end portions of the hinge pin are hexagonal in cross-section and have a maximum diameter which is larger than the diameter of the central portion of the hinge pin which has a smaller circular cross-section. The maximum diameter of the hexagonal end portions is also larger than the inside diameter of the adjustable middle knuckle. Thus, in the embodiment shown in my U.S. Pat. No. 4,490,884, the hinge pin is shown in two segments, an upper segment and a lower segment, and insertion of the hinge pin into the hinge knuckles is accomplished by inserting the smaller circular portions of the two segments into the hinge knuckles from opposite ends. The two segments are held together by a pin positioned in one of the circular portions which is received within an axial hole in the other circular portion.

SUMMARY OF THE INVENTION

In the adjustable friction hinge shown, described and claimed in my U.S. Pat. No. 4,490,884, the adjustable middle knuckle is molded thermoplastic. The thermoplastic has some resilience but prior to my discovery it was not believed that the knuckle extensions could be opened wide enough to expand the inside of the middle knuckle sufficiently to allow the larger hexagonal end portion of the hinge pin to pass through without exceeding the elastic limit of the material or at least without weakening the material to an undesirable or unacceptable extent. Based on this prior belief, the hinge pin was constructed of two segments pinned together at the center, as just described, since by so doing, the larger hexagonal end-portions of the hinge pin did not have to pass through the smaller-diameter adjustable middle knuckle.

I have discovered that by using proper thermoplastic material, it is feasible to open the extensions of the middle knuckle wide enough to expand the inside of the middle knuckle sufficiently to allow the larger hexagonal-end portion of the hinge pin to pass therethrough, thereby permitting the use of a unitary hinge pin rather than a two-segment hinge pin. This discovery avoids the need for a connecting pin, simplifies the construction and the assembly, and reduces the cost of manufacture.

DETAILED DESCRIPTION OF THE PREFERRED EMBODIMENTS

Figure 1:
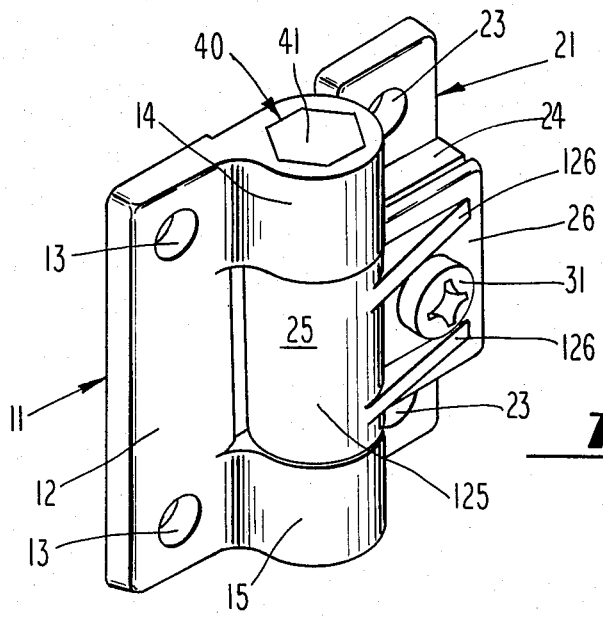
FIG. 1 is a perspective view of a hinge assembly according to the present invention.

FIGS. 1–9 show a hinge assembly which incorporates the improvement of the present invention. In FIG. 1, the position of the hinge is shown to be vertical. While the hinge of the present invention can be used on doors which swing on vertical hinges, the widest use of the hinge is on doors, lids or covers which swing on horizontally-disposed hinges and which, when the door, lid or cover is raised to gain access to the interior, are intended to remain in the raised position without falling down.

Figure 2:
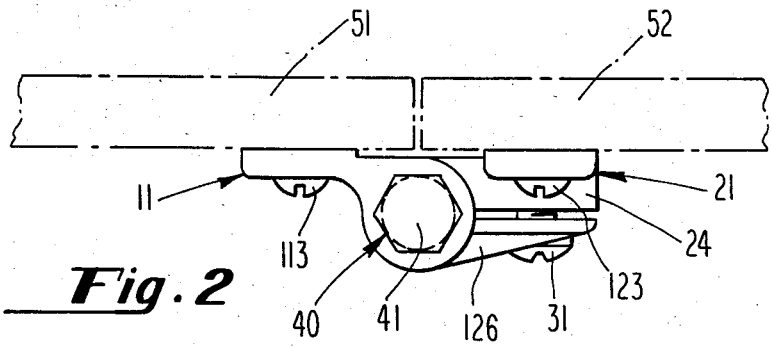
FIG. 2 is a side view of the hinge assembly of FIG. 1.

The hinge assembly comprises a first hinge leaf 11 and a second hinge leaf 21. One of these leaves is secured to the frame while the other is secured to the pivotally-movable door, cover or lid. In FIG. 2, the first hinge leaf 11 is shown to be secured to the cover or lid 51 while the second hinge leaf 21, which includes the adjustable middle knuckle, is shown to be secured to the frame 52. However, these positions can be reversed.

Figure 3:
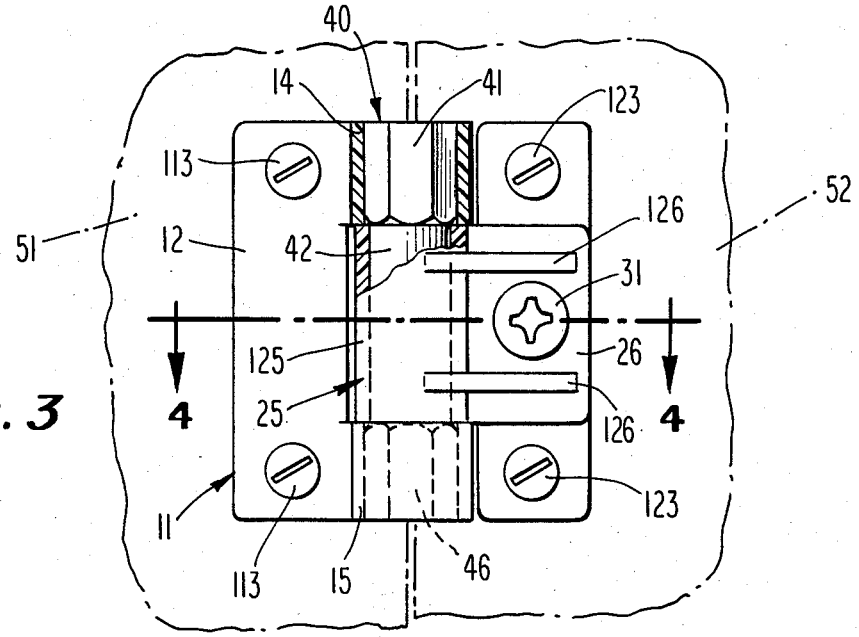
FIG. 3 is a plan view having a cut-away portion to show a portion of the hinge pin.

Hinge leaf 11 has a flat portion 12 which is provided with a pair of holes 13 for receiving screws 113, not shown in FIG. 1 but seen in FIGS. 2 and 3. Hinge leaf 11 includes a pair of spaced-apart knuckles 14 and 15, each of which has a center hole or bore for receiving the hinge pin 40. The hole or bore in the non-adjustable knuckles 14, 15 is non-circular in cross-section for the purpose of receiving a correspondingly-shaped non-circular end portion of hinge pin 40. In the preferred embodiment, the non-circular hole or bore is hexagonal for the purpose of receiving a hinge pin 40 having hexagonal end portions 41, 46. Between the hexagonal end portions, is a central portion 42 which is circular in cross-section. The diameter of the central portion 42 is smaller than the maximum diameter of the hexagonal end portions 41, 46. The non-circular hole in the knuckles 14, 15 and the non-circular end portions 41, 46 of the hinge pin 40, instead of being hexagonal, could be square, or rectangular, or octagonal, or other non-circular shape.

Hinge leaf 21 includes an adjustable knuckle 25 which functions as a clamp. Knuckle 25 is inserted into the space between the two non-adjustable spaced-apart knuckles 14, 15 of the hinge leaf 11. Knuckle 25 has a wrap-around portion 125 from which extend a pair of extensions 24, 26. Extension 24 is integral with the body of hinge leaf 21. Extension 26 is an outer extension the position of which relative to that of extension 24 is adjustable by means of an adjustment screw 31. When adjustment screw 31 is tightened, the spacing between extensions 24, 26 is reduced and wrap-around portion 125 is caused to embrace the cylindrical center portion of hinge pin 40 more tightly, thereby increasing the frictional torque resistance between pin 40 and knuckle 25. A pair of ribs 126 reinforce the connection between the wrap-around portion 125 and adjustable extension 26. The flat portion of hinge 21 includes a pair of holes 23 for receiving screws 123 which are used to fasten hinge leaf 21 to the frame or cover 52.

Figure 5:
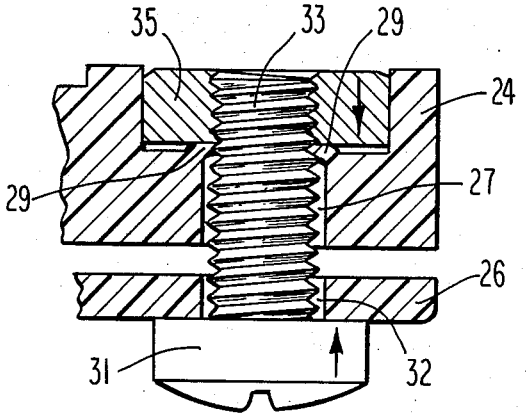
FIG. 5 is a greatly enlarged view of that portion of the hinge assembly which is found within the dot and dashed line rectangle 5 of FIG. 4.
Figure 4:
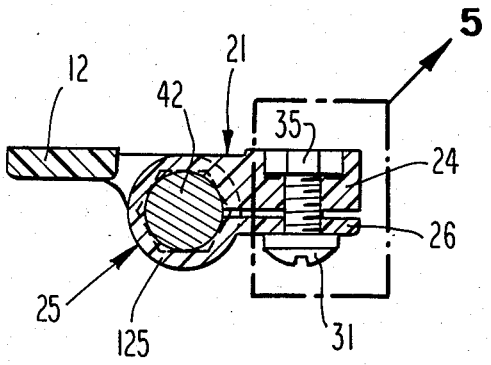
FIG. 4 is a view in section looking along the line 4—4 of FIG. 3.
Figure 6:
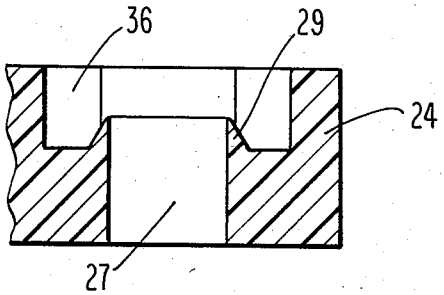
FIG. 6 shows a portion of FIG. 5 before the adjusting screw is tightened.

FIG. 4 is a side view showing in cross-section the adjustable hinge leaf 21 and the manner in which the clamping knuckle 25 is wrapped around the cylindrical (circular cross-section) portion 42 of the hinge pin 40 and tightened by screw 31. FIG. 5 is an enlarged view of that portion of FIG. 4 shown within the dot-and-dash rectangle 5. FIG. 6 is an enlarged view of a portion of FIG. 5.

Referring now to FIGS. 4, 5 and 6, the inner extension 24 of clamping knuckle 25 is provided with a non-circular recess 36 FIG. 6, preferably hexagonal in shape, for receiving a non-circular nut 35 of corresponding size and shape, preferably hexagonal. The fixed inner portion 24 is provided with a circular screw hole 27 which connects with the noncircular recess 36. The outer extension 26 of the clamping knuckle 25 is provided with a circular screw hole 32. The holes 32 and 27 are in registry to receive the shank portion 33 of adjustment screw 31. At the upper edge of hole 27 the thermoplastic material of extension 24 is characterized by an elevated or raised portion or ring 29 which encircles the hole 27. The ring 29 may preferably be triangularly in cross section, with one wall inclining downwardly and outwardly as seen enlarged in FIG. 6. When, as illustrated in FIG. 5, the adjustment screw 31 is tightened, the hexagonal non-rotatable nut 35 is drawn against the ring 29 of portion 24 and, as screw 31 continues to be tightened, the thermoplastic flexible material of ring 29 is squeezed into the threads of the threaded shank 33 of the adjustment screw 31. This applies to the screw thread a drag sufficient to prevent loss of adjustment during normal use.

As has already been indicated above, clamping knuckle 25 is a piece of molded thermoplastic material comprising inner extension 24, wrap-around portion 125 and outer extension 26. As molded, wrap-around portion 125 has a curvature having a fixed radius of such a dimension that the hexagonal end portions of the hinge pin 40 are too large to be inserted into the knuckle opening. However, by spreading the inner and outer extensions 24, 26 apart, in the manner indicated by the arrows in FIGS. 8 and 9, the radius of the wrap-around portion 125 is enlarged sufficiently to permit the hexagonal end portion 46 of the hinge pin 40 to be inserted into the opening, as illustrated in FIG. 9.

Figure 8:
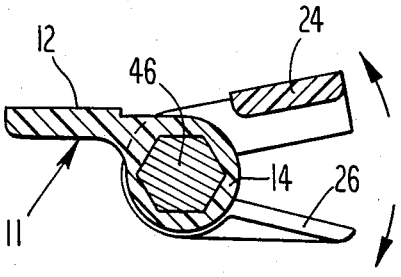
FIG. 8 is a view in section looking down along the line 8—8 of FIG. 7.
Figure 9:
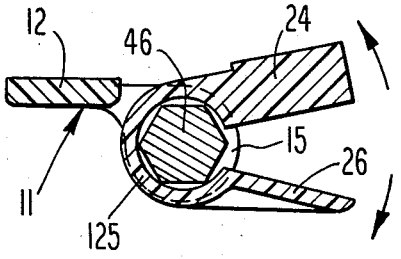
FIG. 9 is a view in section looking down along the line 9—9 of FIG. 7.
Figure 7:
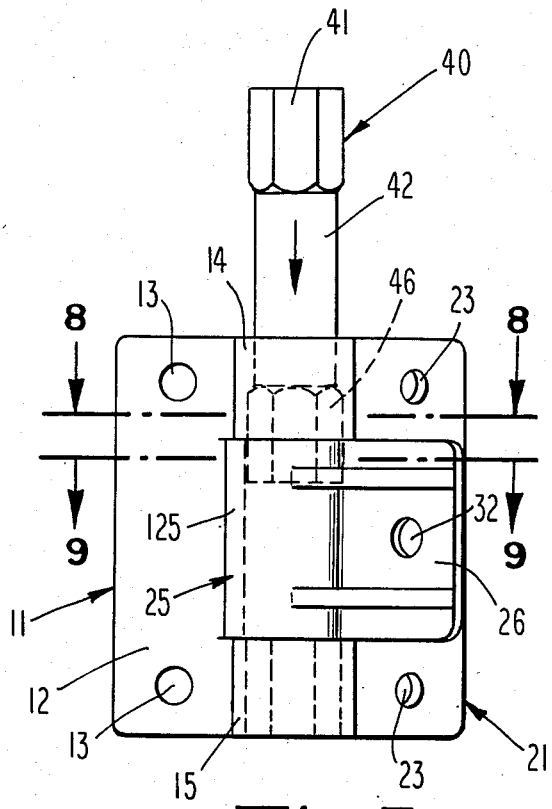
FIG. 7 is a plan view showing the enlarged hexagonal end of the unitary hinge pin being inserted into the expanded bore of the middle knuckle.

FIGS. 7, 8 and 9 illustrate the condition of the adjustable friction hinge at the moment of insertion of the hinge pin 40. In FIG. 7, the lower hexagonal end portion 46 of hinge pin 40 has been inserted into and part way through the upper knuckle 14. The lower portion of the lower hexagonal end portion 46 of hinge pin 40 has been inserted into the expanded opening of the wrap-around portion 125 of clamping knuckle 25. This allows the hinge pin 40 to be inserted, as a unitary piece, into the assembled hinge leaves. After hinge pin 40 is fully inserted, screw 31 is inserted through hole 32 of upper extension 26 and through hole 27 in lower extension 24, and then threaded into the hexagonal nut 35, as shown in FIG. 5.

I have found that if the clamping knuckle 25 is initially molded to have a radius of curvature at the wrap-around portion sufficiently large to provide an opening which will receive the larger hexagonal end portion of the hinge pin 40 without need to spread the lower and upper extensions 24, 26, then the closing of extensions 24, 26 to contact the pin on circular portion 42 will result in long term internal stress and therefore distortion in clamping knuckle 25. Such molding in opened configuration would also reduce the accuracy of the registry of holes 27 and 32 when in the closed position. This would result in production difficulties as well as impairing the function due to distortion of the clamp knuckle.

Assuming that it is desirable that the adjustable friction hinge have a hinge pin whose hexagonal end portions have a maximum diameter larger than the diameter of the circular cross-section middle portion, and assuming further that the thermoplastic clamping knuckle must be molded to have a radius of curvature such that the opening of the clamping knuckle is too small to receive the larger hexagonal end portions of the hinge pin, it was believed heretofore that it would not be feasible to expand the radius of curvature of the inside of the clamping knuckle sufficiently to receive the larger hexagonal end portion of the hinge pin. However, I have calculated that the percent strain in the thin wall of the knuckle is only about two percent (2%). The percent strain is defined as the percent change in the inside-surface arc length as molded due to change in the inside radius of curvature. In making the calculations of percentage strain, the variables to be considered are the inside arc length as molded, the inside arc length during expansion, the inside radius as molded, the inside radius during expansion, and the wall thickness. I have made calculations for smaller size hinges having a molded inside radius of 0.156", an expanded inside radius of 0.176" and a wall thickness of 0.032", and also for larger size hinges having a molded inside radius of 0.252", an expanded inside radius of 0.289" and a wall thickness of 0.046". In both cases, the percent strain is of the order of two percent (2%). This is below the yield point of the thermoplastic material which may preferably be used for the clamping knuckle. Such preferred thermoplastic materials are DuPont Delran and Celanese Celcon. Short-term loads are, of course, assumed.

What is claimed is:

1. An adjustable friction hinge of thermoplastic material, said hinge comprising:

(a) a first hinge leaf having first and second knuckles at spaced separation, each of said first and second knuckles having a non-circular hole therethrough;

(b) a second hinge leaf having a clamping knuckle adapted to be received into the spaced separation between said first and second knuckles of said first hinge leaf, said clamping knuckle having inner and outer clamping extensions for adjusting the inside radius of said clamping knuckle, each of said clamping extensions having a bolt hole therethrough, said bolt holes being in registry with each other, said inner clamping extension having a non-circular recess therein;

(c) a hinge pin having non-circular end portions and a circular cross-section intermediate portion, said non-circular end portions having a maximum diameter larger than that of the circular intermediate portion and also larger than the inside diameter of said clamping knuckle, said non-circular end portions of said hinge pin being received within said spaced-apart non-circular through holes of said spaced-apart first and second knuckles of said first hinge leaf, said circular intermediate portion of said hinge pin being received within the adjustable inside diameter of said clamping knuckle, one of said non-circular end portions of said pin being receivable during assembly within the expanded inside diameter of said clamping knuckle;

(d) an adjustment screw having a shank adapted to pass through said bolt holes of said clamping extensions for adjusting the inside diameter of said clamping knuckle;

(e) a non-circular nut of corresponding size and shape provided in said non-circular recess of said inner clamping extension for receiving a threaded shank portion of said adjustment screw;

(f) said inner clamping extension having at the base of said non-circular recess an integral elevated ring encircling its bolt hole and contiguous to the periphery thereof, the material of said ring being adapted, during tightening of said adjustment screw, to be compressed by said nut and squeezed into the threads of said adjustment screw, thereby to impose sufficient drag on said screw to maintain the adjustment.

2. An adjustable friction hinge according to claim 1 wherein said elevated ring is triangular in cross-section.

3. An adjustable friction hinge according to claim 2 wherein the outer wall of said ring inclines downwardly outwardly.

4. An adjustable friction hinge according to claim 1 wherein said non-circular through holes of said first and second knuckles are hexagonal in cross-section and wherein said non-circular end portions of said hinge pin are hexagonal in cross-section.

* * * * *